US006960889B2

(12) United States Patent
Park et al.

(10) Patent No.: US 6,960,889 B2
(45) Date of Patent: Nov. 1, 2005

(54) METHOD AND APPARATUS FOR DRIVING ELECTRO-LUMINESCENCE DISPLAY DEVICE

(75) Inventors: Kyung Vin Park, Kyoungsangbuk-do (KR); Se Don Kim, Kyoungsangbuk-do (KR); Yoon Heung Tak, Kyoungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 125 days.

(21) Appl. No.: 10/394,151

(22) Filed: Mar. 24, 2003

(65) Prior Publication Data

US 2003/0178948 A1 Sep. 25, 2003

(30) Foreign Application Priority Data

Mar. 25, 2002 (KR) ..... 10-2002-0016128

(51) Int. Cl.[7] ..... G09G 3/10; G09G 3/30

(52) U.S. Cl. ..... 315/169.2; 315/169.3; 345/76; 345/36; 345/45

(58) Field of Search ..... 314/169.2, 169.3; 345/36, 55, 76, 46, 95, 82, 210–211; G09G 3/10, 3/30

(56) References Cited

U.S. PATENT DOCUMENTS 6,061,041 A 5/2000 Yoshida ..... 345/76
6,339,415 B2 * 1/2002 Ishizuka ..... 345/76
6,462,723 B1 * 10/2002 Yamazaki et al. ..... 345/82
6,473,064 B1 * 10/2002 Tsuchida et al. ..... 345/82
6,617,801 B2 * 9/2003 Ishizuka et al. ..... 315/169.3
2004/0100428 A1 * 5/2004 Satoh ..... 345/76
2004/0160393 A1 * 8/2004 Kato ..... 345/80

FOREIGN PATENT DOCUMENTS

JP 1998-261485 9/1998
JP 11-095723 * 4/1999 ..... G09G/3/30

* cited by examiner

*Primary Examiner*—Trinh Vo Dinh
(74) *Attorney, Agent, or Firm*—Birch, Stewart, Kolasch & Birch, LLP

(57) ABSTRACT

This invention relates to a method for driving an electro-luminescence display device. The method includes the steps of selecting a scan line by applying a scan signal to any one of a plurality of scan lines; and switching between a constant voltage and a constant current to apply data to a plurality of data lines crossing the scan lines. The method switches between the constant voltage source and the constant current source to drive the data lines. As a result, it increases the brightness uniformity and brightness. Therefore, the picture quality can be sustained at a high level.

17 Claims, 9 Drawing Sheets

METHOD AND APPARATUS FOR DRIVING ELECTRO-LUMINESCENCE DISPLAY DEVICE

BACKGROUND OF THE INVENTION

1. Field of the Invention

The present invention relates to an electro-luminescence display device, and more particularly to a method and apparatus for driving an electro-luminescence display device that is adaptive for increasing picture quality.

2. Description of the Related Art

Recently, there has been developed various flat display devices, which can be reduced in weight and bulk where a cathode ray tube CRT has a disadvantage. Such flat display panel includes a liquid crystal display, a field emission display, a plasma display panel, and electro-luminescence (hereinafter, EL) display device.

The structure and fabricating process of the PDP is relatively simple, thus the PDP is most advantageous to be made large-sized, but the light emission efficiency and brightness thereof is low and its power dissipation is high. It is difficult to make the LCD large-sizes because of using a semiconductor process, but since it is mainly used as a display device of a notebook computer, the demand for it increases, however there is a disadvantage that the LCD can hardly be made into a large-sized one and that power dissipation is high due to a backlight unit. Further, light loss by optical devices such as a polarizing filter, a prism sheet and diffusion plate is high and a viewing angle is narrow in the LCD. As compared with this, the EL display device is generally classified into an inorganic EL and an organic EL, and there is an advantage that its response speed is fast, its light-emission efficiency and brightness are high, and it has wide viewing angle. The organic EL display device can display a picture in a high brightness of several ten thousands [cd/m$^2$] with a voltage of about 10[V].

In the organic EL display device, as shown in FIG. 1, there is formed an anode 2 of transparent conductive material on a glass substrate 1, and there are deposited a hole injection layer 3, a light-emission layer 4 of organic material, an electron injection layer 5 and a cathode 6 of metal on top of it. If an electric field is applied between the anode 2 and the cathode 6, holes in the hole injection layer 3 and electrons in the electron injection layer 5 respectively progress toward the light-emission layer 4 to be combined in the light-emission layer. Then, a fluorescent material in the light-emission layer 4 gets excited and transferred to generate a visible light. At this moment, the brightness is not proportional to a voltage between the anode 2 and the cathode 6 but is proportional to a current. Accordingly, an apparatus for driving the organic EL display device generally drives the organic EL display device by a constant current source.

Referring to FIG. 2, the apparatus for driving an organic display device of the related art includes a constant current source 21 applying current to data lines DL1 to DLm, and switching devices 22 and 23 applying a scan high voltage Vhigh and a ground voltage GND to each of scan lines SL1 to SLn.

The data lines DL1 to DLm act as the cathodes in FIG. 1, and the scan lines SL1 to SLn act as the anodes in FIG. 1. There are formed (m×n) number of pixel cells 20 at intersections of m number of data lines DL1 to DLm and n number of scan lines SL1 to SLn. The constant current source 21 is realized as two or more switching devices and a current mirror including the current source. The constant current source 21 synchronized with scan pulses applied to the scan lines SL1 to SLn in accordance with input data applies the constant current to the data lines DL1 to DLm. The switching devices 22 and 23 are realized as transistor devices such as MOS-FET. The switching devices 22 and 23 connected to the scan lines SL1 to SLn sequentially apply negative scan voltages to the scan lines SL1 to SLn to select the scan line where data are displayed. To this end, the switching devices 22 connected to the ground voltage source GND are turned on in response to a control signal T1 to apply the ground voltage GND to the selected scan line, and the switching devices 23 connected to the scan high voltage source Vhigh is turned on in response to a control signal T2 to apply the scan high voltage Vhigh to an unselected scan line.

FIG. 3 represents scan pulses applied to the scan lines SL1 to SLn, and data pulses applied to the data lines applied to the data lines DL1 to DLm.

Referring to FIG. 3, scan pulses SCAN are sequentially applied as negative voltages, i.e., forward voltage, to the scan lines SL1 to SLn, and data pulses DATA synchronized with the scan pluses SCAN are applied as positive current to the data lines DL1 to DLm. At this moment, light is emitted only at the pixel cells DATA to which the positive current is applied in accordance with the data among the pixel cells DATA connected to the scan lines SL1 to SLn to which the negative voltage is applied.

On the other hand, charges of reverse direction are charged in both ends of the pixel cell 20 connected to the unselected scan line. In such a state, if the scan line is selected when the negative voltage is applied to the unselected scan line, the pixel cells 20 charged with the reverse charges takes a considerable delay time Δt for being charged to a desired positive data current level as in a data RDATA applied to an actual EL panel of FIG. 4. This is because the input current applied to the pixel cells 20 charged with the reverse charges is wasted by the reverse charge.

The data delay of the organic EL display device can be explained more particularly through Formula 1. When the equivalent capacitance of the pixel cell 20 is C, the voltage charged in the pixel cell 20 is V, the amount of charges charged in the pixel cell 20 is Q, and the current inputted to the pixel cell 20 is I, the charge amount charged in the pixel 20 is determined as in the following Formula 1.

$$Q=C\times V=I\times t \qquad \text{[FORUMULA 1]}$$

If the current is uniform in accordance with time, the time t taken to charge the pixel cell 20 to a desired voltage is (C×V)/I. For example, if C is 2.4 [nF] and I is 200 [ ], the time taken to charge the pixel cell 20 to 10[V] is (2.4 [nF]×10[V])/200 [μA]=120 [μs]. Such a charging time is a considerably long time as compared with the light-emission time of a scan line in the organic EL display device.

Such a delay time deteriorates the effective response speed and brightness of the pixel cells 20. In order to compensate the deterioration of the response speed, the current should be increased, but it causes another problem of increasing power dissipation to occur because the driving voltage of each pixel 20 should be increased.

Further, in the driving apparatus of the EL display device of the relate art, the brightness between the data lines DL1 to DLm is difficult to make uniform because the data lines DL1 to DLm is driven by the constant current source 21. In order to make the brightness between the data lines DL1 to DLm uniform, the current applied to each data line DL1 to DLm must be the same. To this end, it is required to minimize the current deviation scope of a plurality of data driving integrated circuits IC each including the constant current source 21. For example, the current deviation scope of each data driving IC must be limited to within 50±0.5 [$\mu$A] for making the brightness of each data lines DL1 to DLm uniform to be about 20 [nit]. In realizing an actual circuit, designing and fabricating the data driving IC with the current deviation of within 1% not only increases the IC unit price, but also it is difficult to drive each data driving IC in within the desired current deviation even in case that the driving IC's are applied to the actual EL panel.

As a result, the related art EL display device drives the data lines DL1 to DLn by the constant current source 21 to cause the brightness and the brightness uniformity to be decreased, thereby decreasing picture quality.

SUMMARY OF THE INVENTION

Accordingly, it is an object of the present invention to provide a method and apparatus for driving an electro-luminescence display device that is adaptive for increasing picture quality.

In order to achieve these and other objects of the invention, a method for driving an electro-luminescence display device according to an aspect of the present invention includes selecting a scan line by applying a scan signal to any one of a plurality of scan lines, wherein the scan signal falls down to a voltage higher than a ground voltage; and switching between a constant voltage and a constant current to apply data to a plurality of data lines crossing the scan lines.

In the method, a switching is carried out between the constant voltage and the constant current to drive the data lines in accordance with a brightness of a display device that can be controlled by a user.

In the method, the data lines are driven by the constant voltage in a low brightness of the display device, and the data lines are driven by the constant current in a high brightness of the display device.

In the method, the data lines are charged with the constant current in a charging time of the data, and the data lines are driven by the constant voltage when a pixel cell emits light after completion of charging the data.

In the method, the electro-luminescence display device is a passive matrix type.

A driving apparatus for an electro-luminescence display device according to another aspect of the present invention includes a scan driver selecting a scan line by applying a scan signal to any one of a plurality of scan lines, wherein the scan signal falls down to a voltage higher than a ground voltage; and a data driver switches between a constant voltage and a constant current to apply data to a plurality of data lines crossing the scan lines.

The data driver includes a constant voltage source generating the constant voltage; a constant current source generating the constant current; and a switching device connecting any one of the constant voltage source and the constant current source to the data line.

Herein, the data driver switches between the constant voltage and the constant current to drive the data lines in accordance with a brightness of a display device that can be controlled by a user.

Herein, the data driver drives the data lines by the constant voltage in a lower brightness of the display device, and drives the data lines by the constant current in a high brightness of the display device.

Herein, the data driver charges the data lines with the constant current in a charging time of the data, and drives the data lines by the constant voltage when a pixel cell emits light after completion of charging the data.

Herein, the data driver varies a supply time of a voltage and a current applied to the data lines in accordance with a gray level value of an input data.

Herein, the scan driver includes a first switching device for switching a current path between the scan lines and a ground voltage source that generates the ground voltage; a second switching device for switching a current path between the scan lines and a voltage source that generates a specific scan high voltage; and a third switching device for switching a current path between the scan lines and the first switching device.

The scan driver further includes a comparator comparing a voltage in the scan line with a specific reference voltage; and a switching device controlling the voltage in the scan line by control of the comparator.

Herein, the reference voltage is set to be higher than the ground voltage.

Herein, the electro-luminescence display device is a passive matrix type.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

With reference to FIGS. 5 to 9, embodiments of the present invention will be explained as follows.

Figure 1:
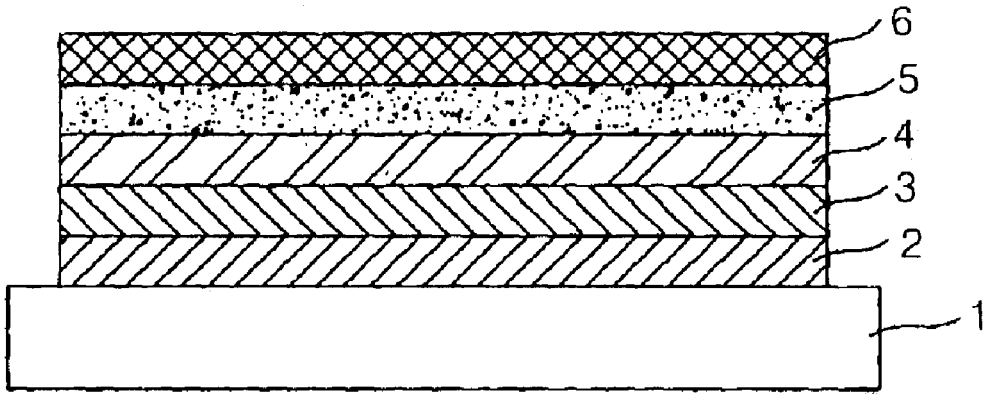
FIG. 1 RELATED ART
FIG. 1 is a sectional view briefly representing an organic electro-luminescence display device of the related art.
Figure 2:
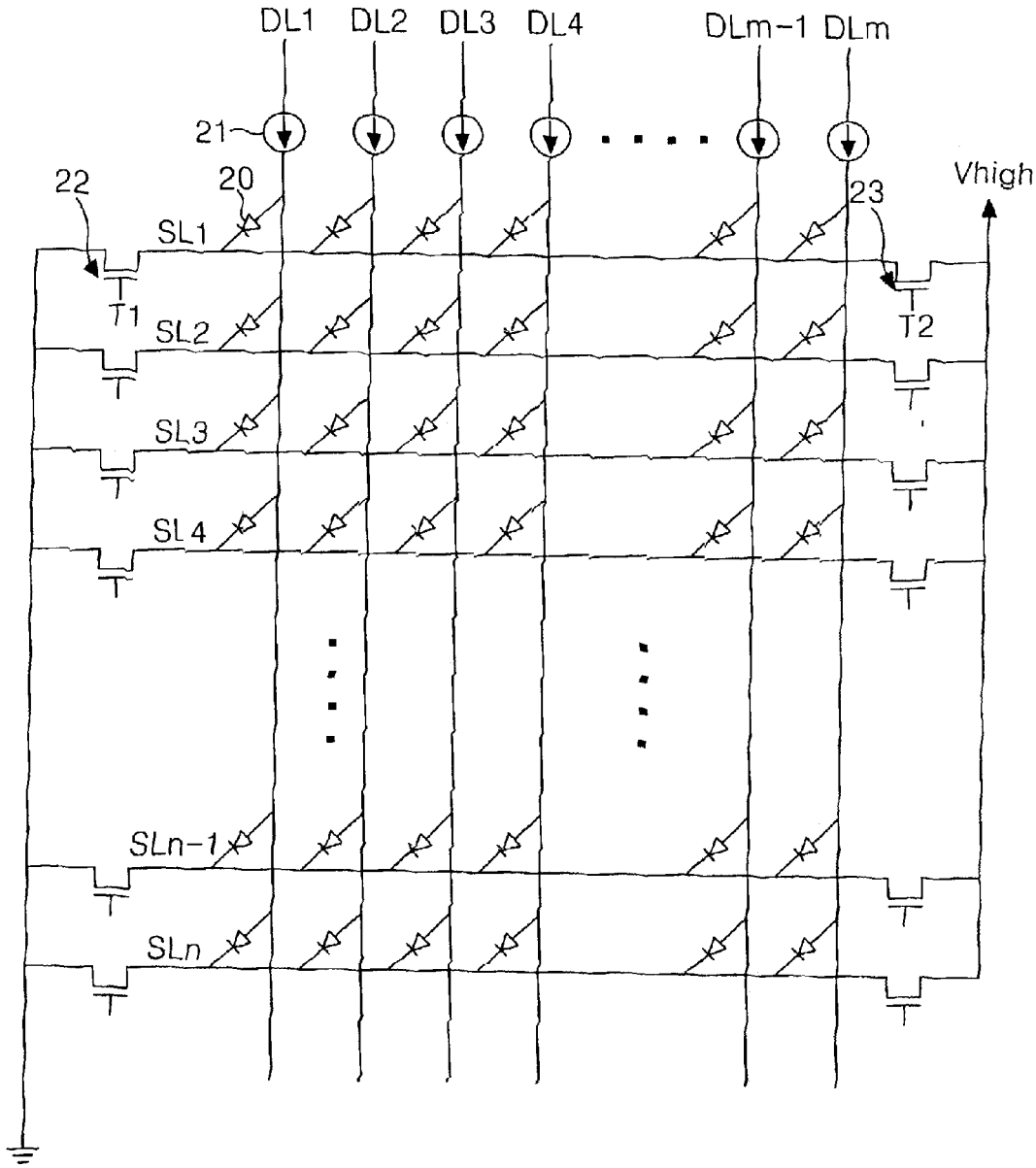
FIG. 2 RELATED ART
FIG. 2 is a plan view representing a driving apparatus and an electrode arrangement of an organic electro luminescence display device of the related art.
Figure 3:
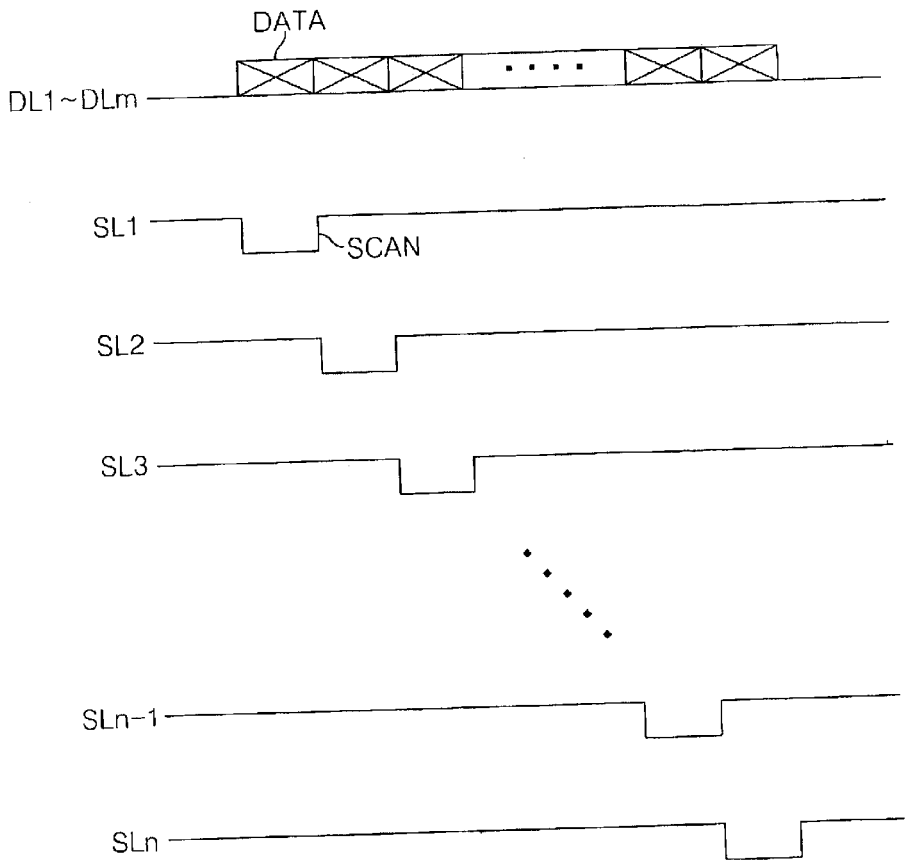
FIG.3 RELATED ART
FIG. 3 is a waveform representing driver signals outputted from the driving apparatus shown in FIG. 2.
Figure 4:
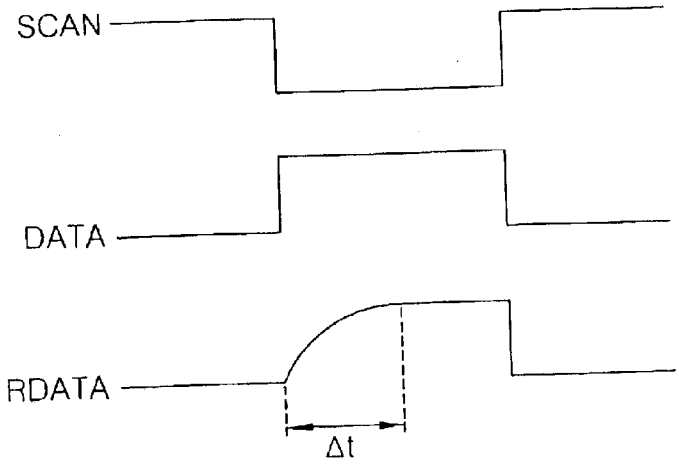
FIG. 4 RELATED ART
FIG. 4 is a waveform representing the delay of data shown in FIG. 3.
Figure 5:
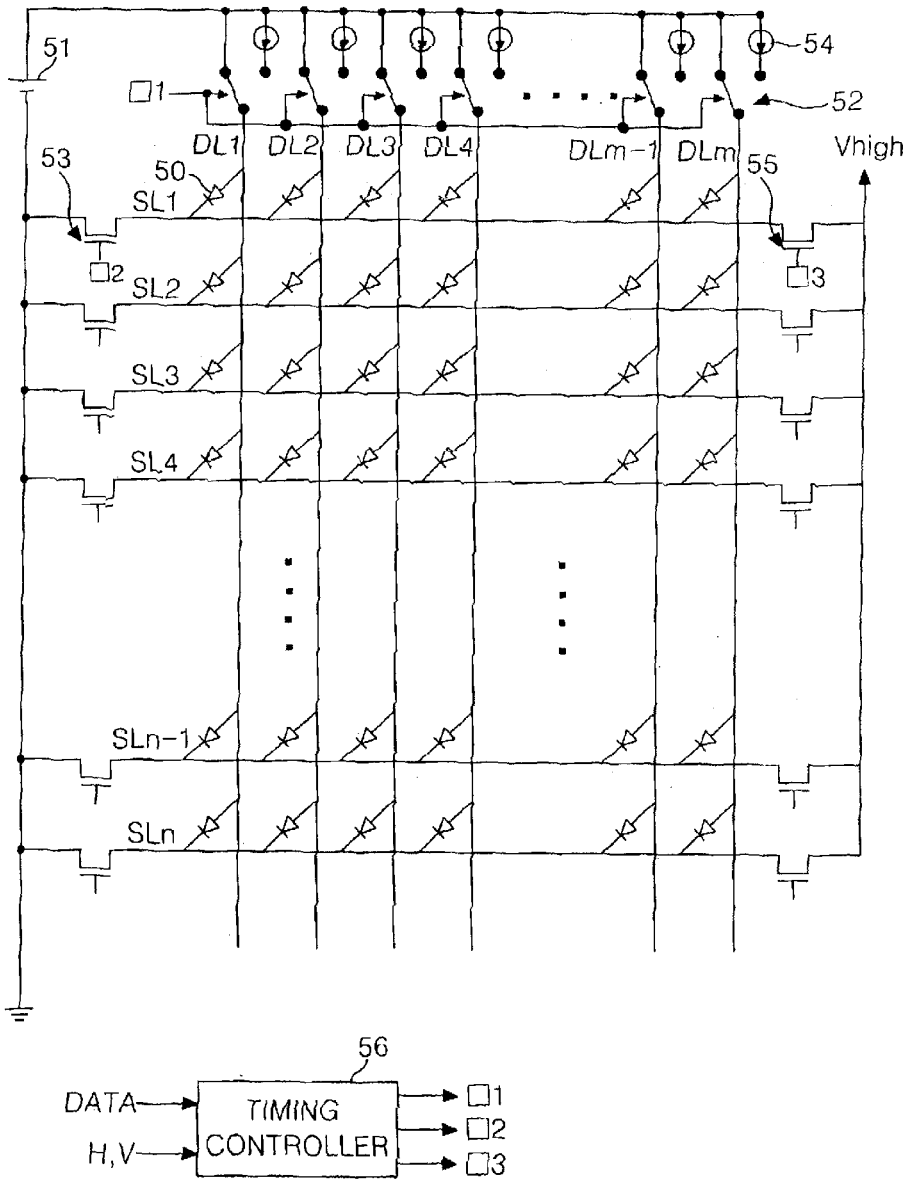
FIG. 5 is a plan view representing a driving apparatus and an electrode arrangement of an organic electro luminescence display device according to the first embodiment of the present invention.

Referring to FIG. 5, a driving apparatus of an EL panel according to the first embodiment of the present invention includes a passive matrix type EL panel, a constant current source 54 for applying currents to data lines DL1 to DLm, a constant voltage source 51 for applying voltages to data lines DL1 to DLm, and a switching device 52 connecting any one of the constant voltage source 51 and the constant current source 54 to the data line DL1 to DLm, switching devices 53 and 55 for applying a scan high voltage Vhigh and a ground voltage GND to each scan line SL1 to SLn, and a timing controller 56 for controlling each of the switching devices 52, 53 and 55.

The EL panel is formed in a passive matrix type. There are formed (m×n) number of pixel cells 50 at intersections of m number of data lines DL1 to DLm and n number of scan lines SL1 to SLn in the EL panel.

The constant current source 54 applies constant currents to the data lines DL1 to DLm while the data lines DL1 to DLm are charged. Further, the constant current source 54 applies the constant current to the data lines DL1 to DLm when displaying a gray level data with big current consumption, e.g., a data, the gray level of which is in an upper half of the whole gray level range. Further, the constant current source 54 applies the current to the data lines DL1 to DLm in the event of a brightness mode with big current consumption, e.g., in the event that brightness mode is adjusted to be high by a user to make the average brightness of a picture adjusted to be several hundreds [cd/m$^2$] or more.

The constant voltage source 51 applies constant voltages to the data lines DL1 to DLm after completion of charging the current. Further, the constant voltage source 51 applies the constant voltage to the data lines DL1 to DLm in a picture with low brightness uniformity, e.g., in a gray level scope that is the lower half of the whole expressible gray levels. And the constant voltage source 51 applies the voltage to the data lines DL1 to DLm in the event that the brightness mode is adjusted to be low by the user to make the average brightness of the picture is adjusted to be low.

The first switching device 52 connects any one of the constant voltage source 51 and the constant current source 54 to the data line DL1 to DLm in response to a control signal Φ1 from the timing controller 56.

The first switch 52 and the constant current source 54 are integrated in a data driving IC. The data driving IC further includes only the first switching device 52 in addition to the circuit configuration of the data driving IC of constant current driving scheme applied to an EL panel driving circuit of the related art, thus it is easy to design and fabricate this data driving IC. The error range for the voltage deviation of such a data driving IC can be easily controlled in 0.1[V] or less.

The switching devices 53 and 55 connected to the scan lines SL1 to SLn sequentially apply negative scan voltages to the scan lines SL1 to SLn to select the scan line where data are displayed. To this end, second switching devices 53 connected to the ground voltage source GND are turned on in response to a control signal Φ2 to apply a ground voltage GND to the selected scan lines, and third switching devices 55 connected to a scan high voltage source Vhigh are turned on in response to a control signal Φ3 to apply a scan high voltage Vhigh to the unselected scan lines. Each of the second and third switching devices 53 and 55 is integrated in a scan driving IC.

The timing controller 56 receives a video data and a vertical/horizontal synchronization signal H and V, generates control signals Φ1, Φ2, Φ3 necessary for the first to third switching devices 52, 53 and 55, and applies the generated control signals Φ1, Φ2, Φ3 to the control terminals of the switching devices.

The method and apparatus for driving the EL according to the present invention has the data lines DL1 to DLm charged with a current determined in accordance with a constant voltage level from the constant voltage source 51 when displaying a data in a gray level range where brightness uniformity decreases easily or a data of low brightness mode, thus the brightness uniformity can be sustained at a high level. Further, the method and apparatus for driving the EL according to the present invention has the data lines DL1 to DLm charged with a current from the constant current source 54 when displaying a data in a gray level range where a sufficient current is required or a data of high brightness mode, thus the brightness of a picture can be increased.

Figure 6:
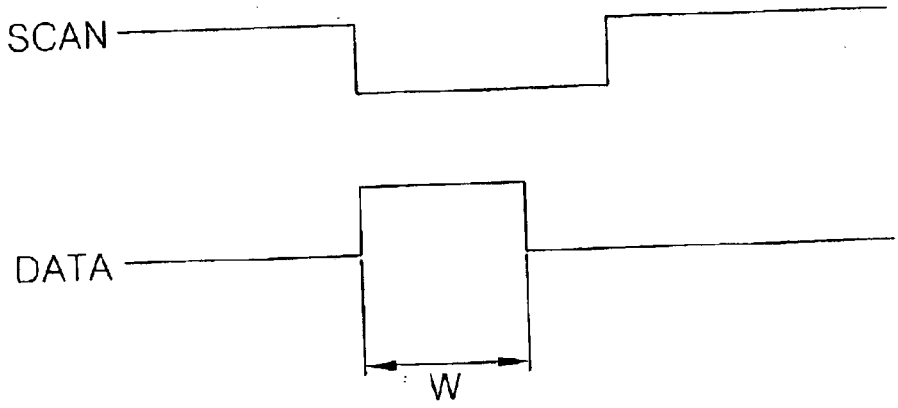
FIG. 6 is a waveform diagram representing a scan pulse and a data pulse outputted from the driving apparatus shown in FIG. 5.

FIG. 6 represents a scan pulse applied to scan lines SL1 to SLn and a data pulse applied to data lines DL1 to DLm shown in FIG. 5.

Referring to FIG. 6, scan pulses SCAN are sequentially applied as negative voltages, i.e., forward voltages, to the scan lines SL1 to SLn, and data pulses DATA synchronized with the scan pluses SCAN are applied as positive voltages to the data lines DL1 to DLm. The width W of the data pulse DATA increases and decreases in accordance with the gray level value of an input data. In other words, the method and apparatus for driving the EL according to the present invention controls the light-emission time of the pixel cell 50 by a pulse width modulation method PWM to express the gray level.

Figure 7:
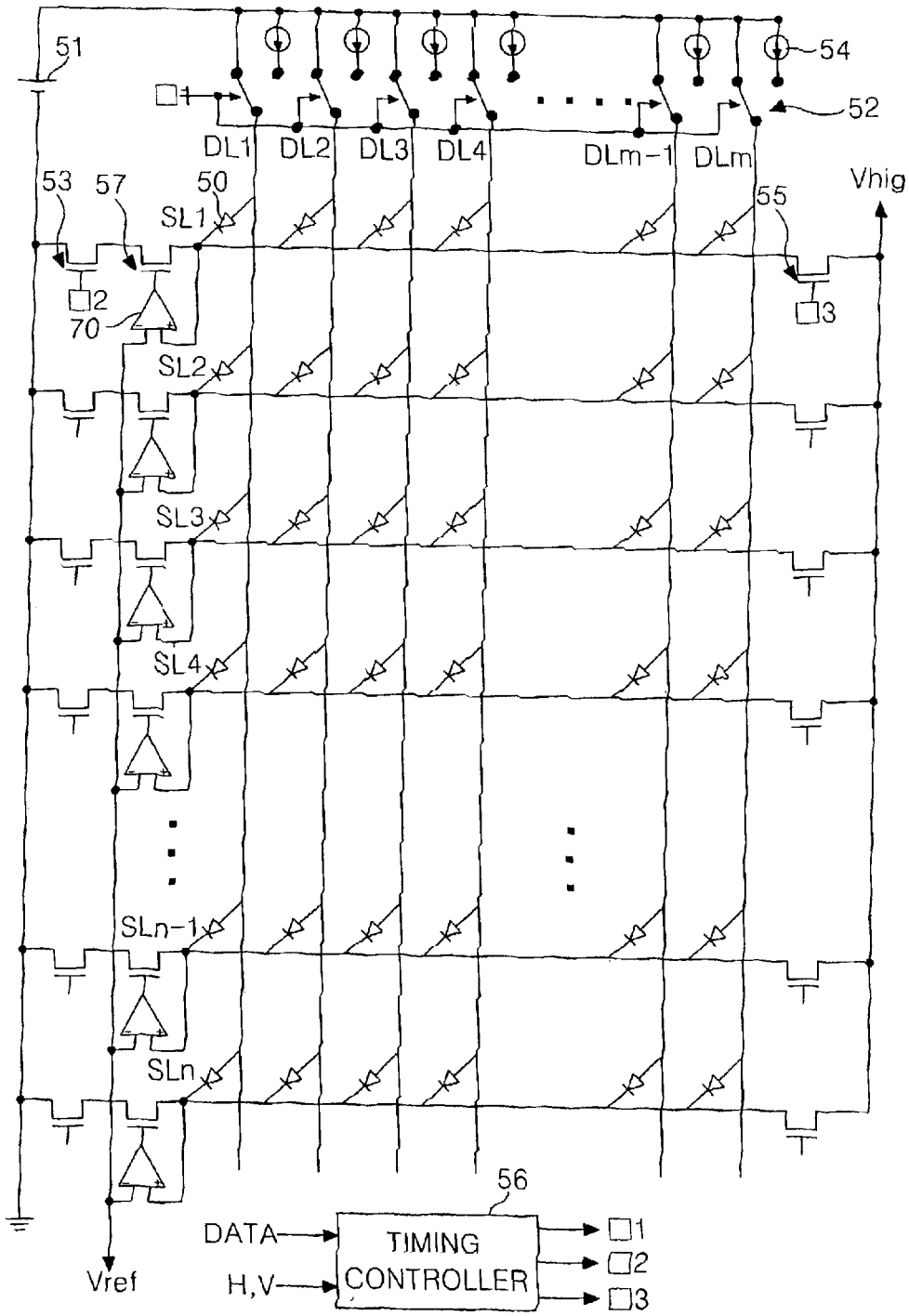
FIG. 7 is a plan view representing a driving apparatus and an electrode arrangement of an organic electro luminescence display device according to the second embodiment of the present invention.

FIG. 7 represents a driving apparatus of an EL panel according to the second embodiment of the present invention.

Referring to FIG. 7, a driving apparatus of an EL panel according to the second embodiment of the present invention includes a passive matrix type EL panel, a constant current source 54 for applying currents to data lines DL1 to DLm, a constant voltage source 51 for applying voltages to data lines DL1 to DLm, and a first switching device 52 connecting any one of the constant voltage source 51 and the constant current source 54 to the data line DL1 to DLm, a second and a third switching device 53 and 55 for applying a scan high voltage Vhigh and a ground voltage GND to each scan line SL1 to SLn, a comparator 70 comparing a specific reference voltage Vref with a voltage in the scan line SL1 to SLn, a fourth switching device 57 for switching a current path between the scan line SL1 to SLn and the ground voltage source GND, and a timing controller 56 for controlling the first to third switching devices 52, 53 and 55.

The constant current source 54 applies constant currents to the data lines DL1 to DLm while the data lines DL1 to DLm are charged. Further, the constant current source 54 applies the current to the data lines DL1 to DLm in data of a gray level range with big current consumption and in a high brightness mode with big current consumption.

The constant voltage source 51 applies constant voltages to the data lines DL1 to DLm after completion of charging the current. Further, the constant voltage source 51 applies the voltage to the data lines DL1 to DLm in data of a gray level range with low brightness uniformity and in a brightness mode with low brightness uniformity.

The first switching device 52 connects any one of the constant voltage source 51 and the constant current source 54 to the data line DL1 to DLm in response to a control signal Φ1 from the timing controller 56.

The first and second switching devices 53 and 55 sequentially apply negative scan voltages to the scan lines SL1 to SLn to select the scan line where data are displayed. To this end, the second switching devices 53 connected to the ground voltage source GND are turned on in response to a control signal Φ2 to discharge the selected scan line to a ground potential GND, and the third switching devices 55 connected to a scan high voltage source Vhigh are turned on in response to a control signal Φ3 to apply a scan high voltage Vhigh to the unselected scan lines.

The timing controller 56 receives a video data and a vertical/horizontal synchronization signal H and V, generates control signals Φ1, Φ2, Φ3 necessary for the first to third switching devices 52, 53 and 55, and applies the generated control signals Φ1, Φ2, Φ3 to the control terminals of the switching devices.

The non-inversion input terminals of the comparators 70 are connected to the scan lines SL1 to SLn, and the inversion input terminals of the comparators 70 are connected to a reference voltage source Vref. The output terminals of the comparators 70 are connected to the control terminals, i.e., the gate terminals, of the fourth switching devices 57. Each comparator 70 compares the reference voltage Vref with a voltage in the scan line SL1 to SLn and generates an output signal of low logic when the voltage in the scan line SL1 to SLn is lower than the reference voltage Vref. And then, the generated output signal is applied to the control terminal of the fourth switching device 57. If the voltage in the scan line SL1 to SLn is equal to or higher than the reference voltage Vref, each comparator 70 generates an output signal of high logic to apply the generated output signal to the control terminal of the fourth switching device 57. The fourth switching devices 57 cut off a current path between the drain terminal and the source terminal when the voltage in the scan line SL1 to SLn is lower than the reference voltage Vref in response to the output signal of low logic of the comparator. If the voltage in the scan line SL1 to SLn is equal to or higher than the reference voltage Vref, the fourth switching devices 57 allows the current path to conduct between the drain terminal and the source terminal in response to the output signal of high logic of the comparator.

Figure 9:
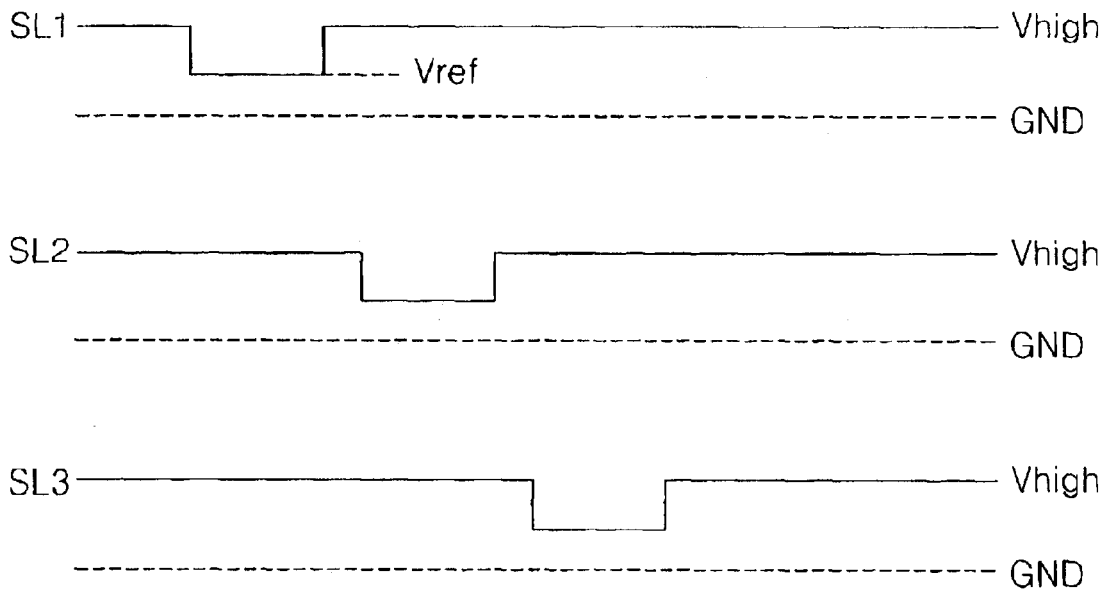
FIG. 9 is a waveform diagram representing a scan voltage controlled by a comparator and a third switching device shown in FIGS. 7 and 8.

As a result, the comparators 70 and the fourth switching devices 57, as in FIG. 9, drop the voltage in the scan lines SL1 to SLn not to the ground voltage GND but to the reference voltage Vref in the same manner. In other words, the comparators 70 and the fourth switches 57 act to make the voltage in the scan lines SL1 to SLn drop not to the ground voltage but to a designated reference voltage Vref when scan pulses SCAN are applied to the scan lines SL1 to SLn. This is because the voltage in the scan lines SL1 to SLn rises higher than the ground voltage GND and the deviation of the rising voltage can be different in each scan line SL1 to SLn by causes such as the current deviation of each scan driving IC and the deviation of the current applied to the scan driving IC through the data line DL1 to DLm and the pixel cell 50 when the voltage in the scan line SL1 to SLn drops. To this end, the reference voltage Vref is set to be the maximum voltage rising value of the scan line SL1 to SLn when the scan pulse is applied in consideration of the allowable current of the scan driving IC. The reference voltage Vref is set to be 0.5[V] or more, preferably about 2[V], assuming that ground voltage GND is 0[V].

Figure 8:
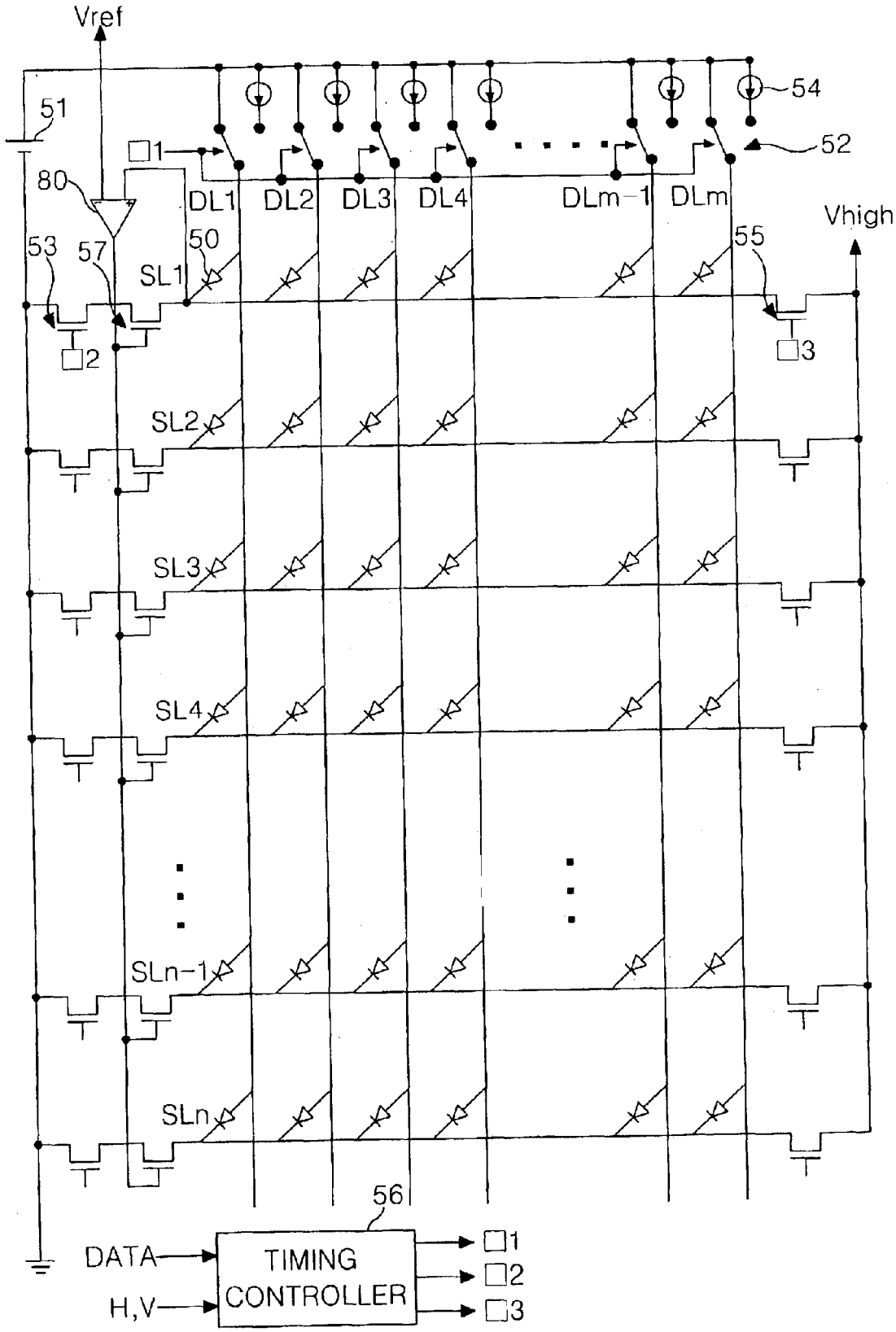
FIG. 8 is a plan view representing a driving apparatus and an electrode arrangement of an organic electro luminescence display device according to the third embodiment of the present invention.

The comparators 70 can be replaced with a common comparator 80 as shown in FIG. 8. The common comparator 80 substantially has the same function as the comparators 70 shown in FIG. 7.

As described above, the method and apparatus of the EL of the present invention drives the data lines DL1 to DLm using the constant voltage source 51 and the constant current source 54 at the same time. As a result, the method and apparatus of the EL of the present invention increases the brightness uniformity and brightness, thus the picture quality can be sustained at a high level.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method for driving an electro-luminescence display device, comprising:

selecting a scan line by applying a scan signal to any one of a plurality of scan lines, wherein the scan signal decreases to a voltage higher than a ground voltage when the scan line is selected; and switching between a constant voltage and a constant current to apply data to a plurality of data lines crossing the scan lines.

2. The method according to claim 1, wherein a switching is carried out between the constant voltage and the constant current to drive the data lines in accordance with a brightness of a display device that is controllable by a user.

3. The method according to claim 2, wherein the data lines are driven by the constant voltage in a low brightness of the display device, and the data lines are driven by the constant current in a high brightness of the display device.

4. The method according to claim 1, wherein the data lines are charged with the constant current in a charging time of the data, and the data lines are driven by the constant voltage when a pixel cell emits light after completion of charging the data.

5. The method according to claim 1, wherein the electro-luminescence display device is a passive matrix type.

6. The method according to claim 1, further comprising:

comparing the voltage in the scan line with a reference voltage; and controlling the voltage in the scan line based on a result of the step of comparing the voltage in the scan line with the reference voltage.

7. The method according to claim 6, further comprising setting the reference voltage to be higher than the ground voltage.

8. A driving apparatus for an electro-luminescence display device, comprising:

a scan driver selecting a scan line by applying a scan signal to any one of a plurality of scan lines, wherein the scan signal decreases to a voltage higher than a ground voltage when the scan line is selected; and a data driver switching between a constant voltage and a constant current to apply data to a plurality of data lines crossing the scan lines.

9. The driving apparatus according to claim 8, wherein the data driver includes: a constant voltage source generating the constant voltage; a constant current source generating the constant current; and a switching device connecting any one of the constant voltage source and the constant current source to the plurality of data lines.

10. The driving apparatus according to claim 8, wherein the data driver switches between the constant voltage and the constant current to drive the data lines in accordance with a brightness of a display device that is controllable by a user.

11. The driving apparatus according to claim 8, wherein the data driver drives the data lines by the constant voltage in a lower brightness of the display device, and drives the data lines by the constant current in a high brightness of the display device.

12. The driving apparatus according to claim 8, wherein the data driver charges the data lines with the constant current in a charging time of the data, and drives the data lines by the constant voltage when a pixel cell emits light after completion of charging the data.

13. The driving apparatus according to claim 8, wherein the data driver varies a supply time of a voltage and a current applied to the data lines in accordance with a gray level value of an input data.

14. The driving apparatus according to claim 8, wherein the scan driver includes: a first switching device for switching a current path between the scan lines and a ground voltage source that generates the ground voltage; a second switching device for switching a current path between the scan lines and a voltage source that generates a specific scan high voltage; and a third switching device for switching a current path between the scan lines and the first switching device.

15. The driving apparatus according to claim 8, wherein the scan driver further includes: a comparator comparing a voltage in the scan line with a specific reference voltage; and a switching device controlling the voltage in the scan line by control of the comparator.

16. The driving apparatus according to claim 15, wherein the reference voltage is set to be higher than the ground voltage.

17. The driving apparatus according to claim 8, wherein the electro-luminescence display device is a passive matrix type.

* * * * *